US006604652B1

(12) United States Patent
Trautwein

(10) Patent No.: US 6,604,652 B1
(45) Date of Patent: Aug. 12, 2003

(54) CIGARETTE VENDING MACHINE

(75) Inventor: Hans-Hermann Trautwein, Ostfildern (DE)

(73) Assignee: Hans-Hermann Trautwein SB-Technik GmbH (DE)

( * ) Notice: Subject to any disclaimer, the term of this patent is extended or adjusted under 35 U.S.C. 154(b) by 0 days.

(21) Appl. No.: 09/807,171

(22) PCT Filed: Sep. 17, 1999

(86) PCT No.: PCT/EP99/06881

§ 371 (c)(1),
(2), (4) Date: Apr. 9, 2001

(87) PCT Pub. No.: WO00/22584

PCT Pub. Date: Apr. 20, 2000

(30) Foreign Application Priority Data

Oct. 10, 1998 (DE) ..... 198 46 791

(51) Int. Cl.[7] ..... G07F 11/06

(52) U.S. Cl. ..... 221/124; 221/2; 221/21; 221/129; 221/258

(58) Field of Search ..... 221/124, 2, 21, 221/129, 130, 131, 133

(56) References Cited

U.S. PATENT DOCUMENTS 2,289,807 A * 7/1942 Schaevitz et al. ..... 221/126
2,590,736 A * 3/1952 Tandler et al. ..... 194/244
3,901,366 A * 8/1975 Schuller et al. ..... 194/210
5,318,194 A * 6/1994 Wiese ..... 221/123
5,959,869 A * 9/1999 Miller et al. ..... 221/9

* cited by examiner

*Primary Examiner*—Donald P. Walsh
*Assistant Examiner*—Jonathan R Miller
(74) *Attorney, Agent, or Firm*—Pendorf & Cutliff

(57) ABSTRACT

The invention relates to a cigarette vending machine, especially for installing in the checkout area of a market or the like, comprising a housing (12) wherein several shafts (16) are located (16). Said shafts accommodate columns of cigarette packs (18) which are oriented upright with their broad sides resting against each other. A discharge outlet for individual cigarette packs is located at the front of the shafts (16). The aim of the invention is to provide a simple means of discharging a cigarette pack whilst ensuring that the packs are suitably presented to the customer. The pack should not however be removed directly from the supply shaft. To this end, an optionally controllable drive mechanism (36, 38, 40) is allocated to each shaft (16). Each drive mechanism has a pressure piece (42) which exerts pressure acting on the back side of the rearmost cigarette pack (18) of the column of packs, urging frontwards. A clamping mechanism (30) for the cigarette packs is also located in the front area of each shaft (16), this clamping mechanism forming the discharge opening when it is open.

35 Claims, 8 Drawing Sheets

CIGARETTE VENDING MACHINE

DESCRIPTION

The invention concerns a cigarette vending machine according to the preamble of patent claim 1.

Generally, in the checkout area of supermarkets, basket-like shelves arranged in a grid are set up for the sale of impulse items, and in particular cigarettes. Due to the easy access to the cigarette packs at the these points, the packs can be removed without detection despite being provided, as a rule, in the area of the cash register; consequently, theft of cigarettes occurs frequently, so that the direct sale of cigarettes in this manner is no longer lucrative.

In a vending machine of the generic type with which the present invention is concerned as disclosed in U.S. Pat. No. 2,590,736, goods are held in an upright orientation by clamping springs provided on the sides and displaced relative to the discharge opening. The forwardmost article is however not held by the springs, and By an abutment flange is provided above each cigarette shaft to prevent a tipping out of the article out of the shaft. This retention means is however unsatisfactory, since a shaking of the machine, which could be produced for example by an angry cigarette vending machine, which makes possible a secure retention of the articles under all conditions.

The solution of this task is proposed by the combination of characteristics set forth in Patent claim 1. Advantageous embodiments and further developments of the invention can be seen from the dependent claims.

The invention is primarily based on the idea, that a secure retention can be achieved particularly when even only the front-most pack of a cigarette shaft is securely held. In accordance with the invention, the clamping spring acts on the narrow side of at least the frontmost cigarette pack. Thereby, even though a retaining action is exercised, the entire front surface of the pack remains unobscured.

Those packs which are situated in a common plane form, in accordance with an advantageous further embodiment of the invention, a row or level of packs which can be loaded with the cigarette packs and can be pulled out in a drawers-like manner within the housing. Further, a conveyor device is preferably provided in the lower front area of the housing for transporting the ejected cigarette pack into the outer area of the vending machine, for example to a cash register.

In a preferred embodiment of the invention the housing has a cover element provided on its front side, preferably a glass or Plexiglas pane. This provides supplemental protection, so that the cigarette packs cannot be removed directly from the shafts. In order to be able to refill the individual shafts with cigarette packs in a simple manner from the front, the cover element is preferably mounted to the housing pivotably or foldably, for exposing the shaft levels or rows.

Since the ejection of cigarette packs occurs under force by the drive mechanism, a forward moving of the following packs by gravity is not necessary, so that the shaft levels or as the case may be the shafts can be oriented essentially horizontally in the housing.

In a preferred embodiment of the invention the drive mechanism for each cigarette shaft includes preferably one electrical drive motor, as well as drive means for transmission of a drive force to a spindle or threaded rod provided below the cigarette shaft, wherein the drive means can comprise a belt, band, chain or gear drive. Further, the drive means is preferably provided with or in the form of a reduction gear.

The cigarette shaft levels have a floor preferably comprised of sheet metal, in which a slit-like guide opening extends in the longitudinal direction of each shaft for an internally-threaded drive piece of the push piece, which cooperates with the externally threaded rod.

In order to be able to introduce or, as the case may be, to remove the push piece in simple manner in the cigarette shaft, the guide opening is preferably at least on one end, preferably in the rear area of the shaft, designed to be open. It is however also possible that the guide openings respectively have a closed end and that the push piece, is comprised of two parts, which during assembly are connected through the opening. In order to make possible a simple movement of the push piece along the opening, the push piece should be introduced into the guide opening with play, i.e. loosely. According to a preferred embodiment of the invention the drive piece of the push piece engages or surrounds the spindle no more than 180°, so that the push piece can be lifted out of the spindle. In this manner, when the push piece reaches its forward-most position, that is, when all cigarette packs have been ejected from the shaft, it can be rapidly pushed back to its rearward-most starting position, without requiring a time-consuming driving back to the return position by means of the drive mechanism.

An appealing presentation and an even further improved gripping or supporting of the packs is achieved thereby, that two clamp springs are provided for each shaft acting symmetrically on opposite narrow sides of the cigarette packs. In a preferred embodiment of the invention the at least one clamping spring is formed as a leaf spring extending along the longitudinal direction of the shaft, wherein the free end of the leaf spring extends in the direction of the shaft front. Hereby a guidance for the packs is supplementally achieved, in that the spring not only acts on the front-most pack, but rather also, in lesser amount, on the second and/or third pack from the front. A particularly simple construction is achieved, when the clamp spring is formed as an essentially V-shaped piece of bent sheet metal, which with its tip or apex is inserted in a slit in a shaft-divider dividing the shafts from each in the longitudinal direction. The one shank of the spring acts on the narrow side the packs in one cigarette shaft, while the other shank acts on the packs in the adjacent shaft.

The stocking or refilling of the cigarette shafts is simplified thereby, that each shaft layer is provided with two capture hooks projecting from the front-side along the edge, provided for hooking in, during refilling of the cigarette shaft, of a refilling member or bar or rod which closes off the cigarette shaft front. When the shaft layer is pulled out in the manner of a drawer, and then the refilling member is hung in on the left and right capture hooks provided outside on the shaft level, and the cigarette packs are introduced into the respective shafts, the front broad side of the respectively front-most pack lies against the refill member. Thereafter the refill member is again removed and the filled shaft level is pushed back into the housing. The refill rod can be stored in a suitable position inside the housing when not in use.

When the cover window is closed, a gap is formed between the window and the front side of the shaft levels, through which the ejected cigarette packs fall downwards onto the conveyor device. In order to prevent a hanging up or trapping of a downward-falling cigarette pack on the front side of one of the lower-lying shafts, there is preferably provided on the lower front side of respectively each shaft level a cover or orifice plate extending along the breadth of the shaft level, with an outwardly and downwardly directed, slide-forming slanted surface. The slanted surface of the cover plate is designed to project over and beyond the front-most cigarette pack situated in the thereunder lying shaft level. In order to insure a problem-free ejection of the cigarette packs in the horizontal direction, the lower edge of the orifice plate in the area of the slatted surface should have a height above the upper edge of the cover plate of the thereunder lying shaft which height exceeds the height of a cigarette pack. Preferably, the front edge of one of each cover plates exhibits a distance from the cover element or window which exceeds the thickness of the cigarette packs, so that also a sufficient gap spacing is provided for the downward-falling cigarette packs.

The conveyor device can be designed as a conveyor belt or multiple conveyor straps arranged parallel to each other, wherein the latter variant has been found to be particularly useful.

In the cigarette shafts the cigarette packs are arranged standing up and are ejected in this position. Tests have however shown, that the transport of the cigarette pack in the outer area of the vending machine is particularly reliable when the cigarette packs are oriented lying on their broad side. In order to achieve this, a slide for the cigarette packs can be provided in the area of the conveyor device, which slide tilts the cigarette packs landing on it from a standing position to a lying position for further transport.

At the output area of the conveyor device a light barrier or light sensor can be provided for detecting an outward transported cigarette pack, while in accordance with an advantageous further development of the invention a further light sensor, which is provided above the conveyor device and covers the breadth of the shaft levels, produces a turning-off signal for the drive mechanism of a threaded rod after the ejection of a cigarette pack. The light sensor provided in the output area of the conveyor device can serve for monitoring whether an ejected cigarette pack actually has been conveyed towards the outside, while the light sensor provided over the conveyor device can serve for controlling the drive mechanism after the ejection of the cigarette pack.

Further, the conveyor device can be provided with a switch or gate mechanism for transporting a cigarette pack to different destinations, in particular to two different cash registers. Hereby it is possible to service two cash registers using a single vending machine.

According to a further advantageous embodiment of the invention a deposit slot is preferably on the front side of the housing for the return of erroneously selected cigarette packs, behind which there is preferably provided a collection container, removable from the housing, for receiving the returned cigarette packs. Thereby not only a logistical simplification is achieved, but rather also further opportunities for theft are circumvented.

For the selection and control of the drive mechanisms there is preferably provided a keyboard. This can be positioned at the front side of the housing or the cover element. In order to simplify the selection of the cigarette pack as much as possible, the keyboard should exhibit the same number of keys as there are shafts provided in the vending machine. In accordance therewith the individual keys of the keyboard are preferably arranged matrix-like in rows and columns according to the individual shafts, and the position of each key of the keyboard is associated with a position corresponding to a shaft.

Alternatively thereto, the keyboard can be designed as a number key pad, wherein each shaft is assigned a position number and the selection of the designed cigarette pack occurs by the keyboard entry of the position number of the appropriate shaft. In this case there should be provided in the area of the key pad or the front side of the housing a display for indicating the selected shaft or the selected shaft number, and the key pad should be provided with a confirmation key for controlling the drive mechanism of the selected shaft and the ejection of the selected cigarette pack.

If an empty cigarette shaft is selected or if a driver is inoperative, so that no pack is ejected after a selection has been made, then this fact is registered by the light detector and the drive mechanism of the shaft is turned off via the control electronics of the vending machine. The re-initialization of the drive of a cigarette shaft turned off in this manner can occur only after opening the cover element, wherein a door or cover element contact switch brings about a resetting of the disablement. Likewise, the operation of the vending machine should be prevented for safety reasons when the cover element is open for filling the vending machine. For this, a safety switch operable by the cover element, which disables operation when the cover element is opened, can be provided.

An operation of the vending machine should also be prevented when the respective cash register, in the area in which the cigarette vending machine is situated, is not open for business. For this purpose a remote control switch can be provided remote from the vending machine, preferably in the area of the cash register, for disabling or enabling use of the vending machine. A further security measure would be an acoustic indication produced by the operation of the vending machine, which signals the operating personnel that a cigarette pack has been ejected.

For logistical simplification, a counter can be provided for registering the number of sales which have occurred in the vending machine.

Besides the most common pack size, the 85 mm pack, which contains 19 or 20 cigarettes, there are also longer cigarette packs ("100's") and the so called "big packs", which contain 25 cigarettes and are dimensioned correspondingly broader. In order to also be able to offer packs of this size, at least one shaft or one shaft level should be designed for receiving these cigarette packs. By the presence of the clamping springs, it is however also possible that all shafts have a uniform breadth, wherein these springs have a sufficient stroke or travel path for taking into consideration that the broader packs could also be present in any of the various cigarette shafts.

BRIEF DESCRIPTION OF THE DRAWINGS

In the following the invention will be described in greater detail on the basis of the illustrated embodiment shown in the figures. There is shown.

DETAILED DESCRIPTION OF THE INVENTION

Figure 1:
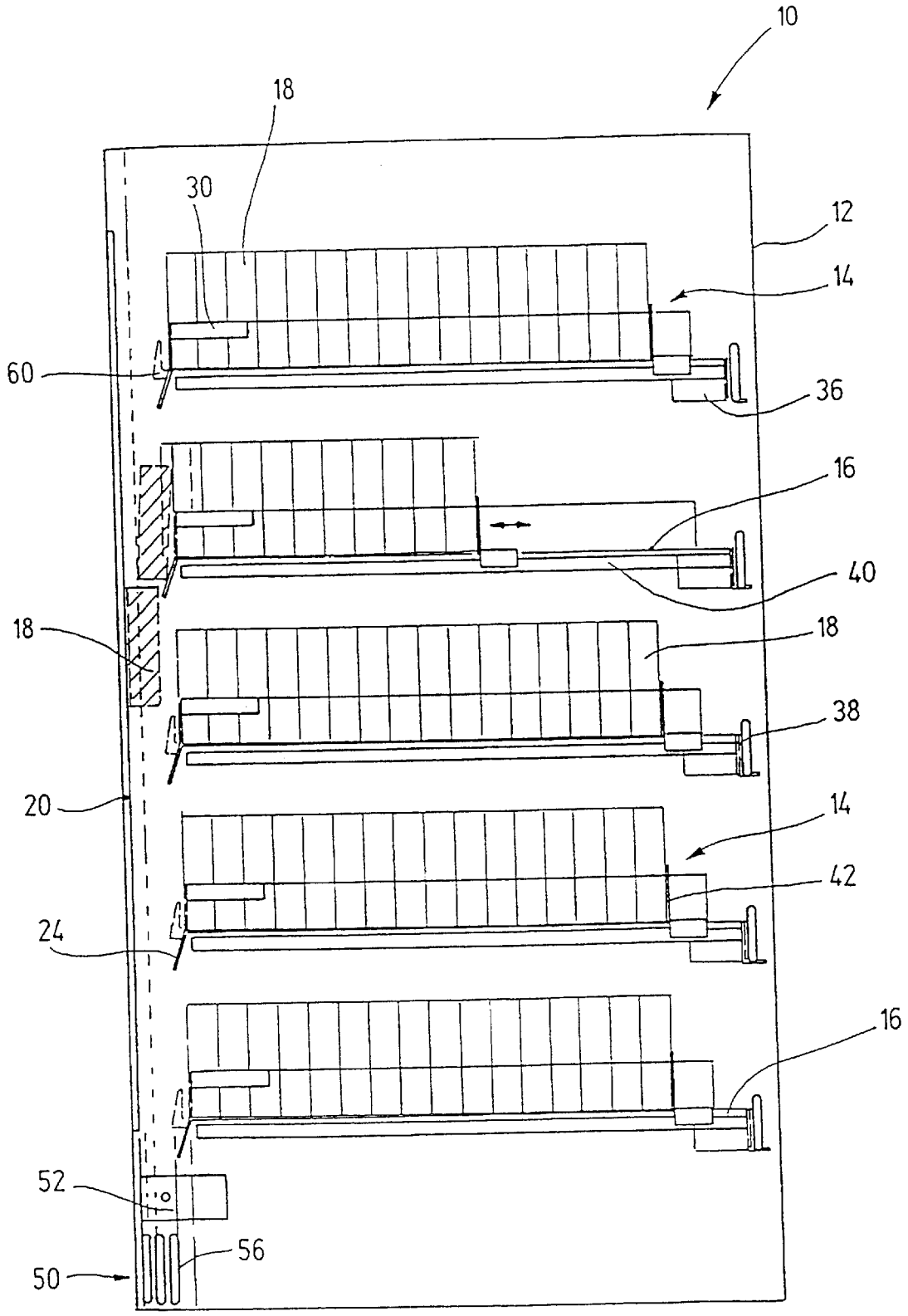
FIG. 1 a section through the illustrative embodiment of an inventive cigarette vending machine with five shaft levels.

The cigarette vending machine represented in the drawings and designated overall with reference number 10 is comprised essentially of a housing 12 in which a number of shaft levels 14 with individual cigarette shafts 16 are arranged. In the illustrated embodiment, the vending machine 10 comprises five shaft levels 14 with respectively twelve shafts 16, thus a total of sixty shafts. With a loading capacity of twenty sequentially arranged standing cigarette packs 18 per shaft, the result is a total capacity of 1200 packs.

Figure 2:
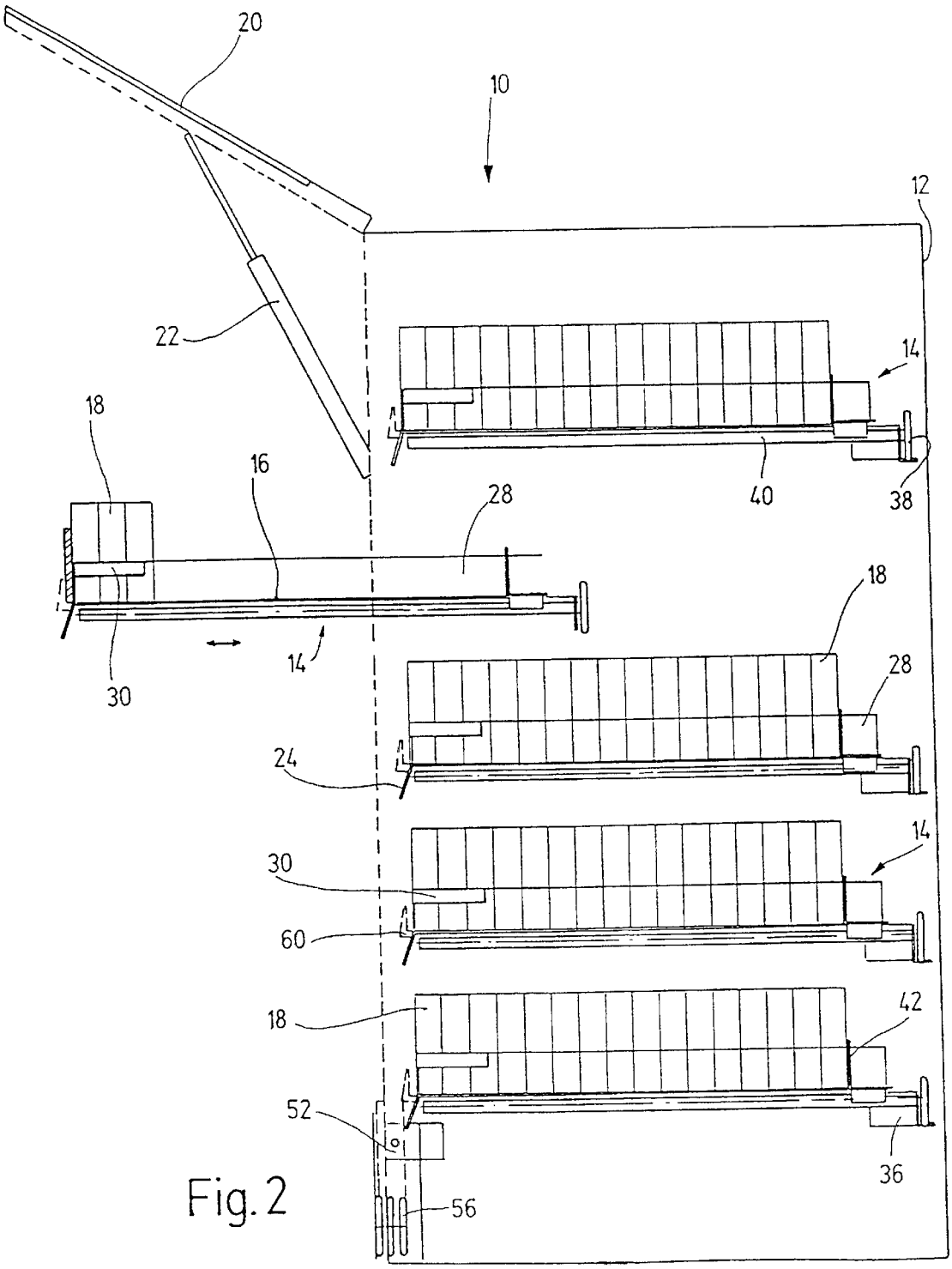
FIG. 2 the cigarette vending machine according to FIG. 1 with open cover element and one shaft level in the loading or restocking position.
Figure 3:
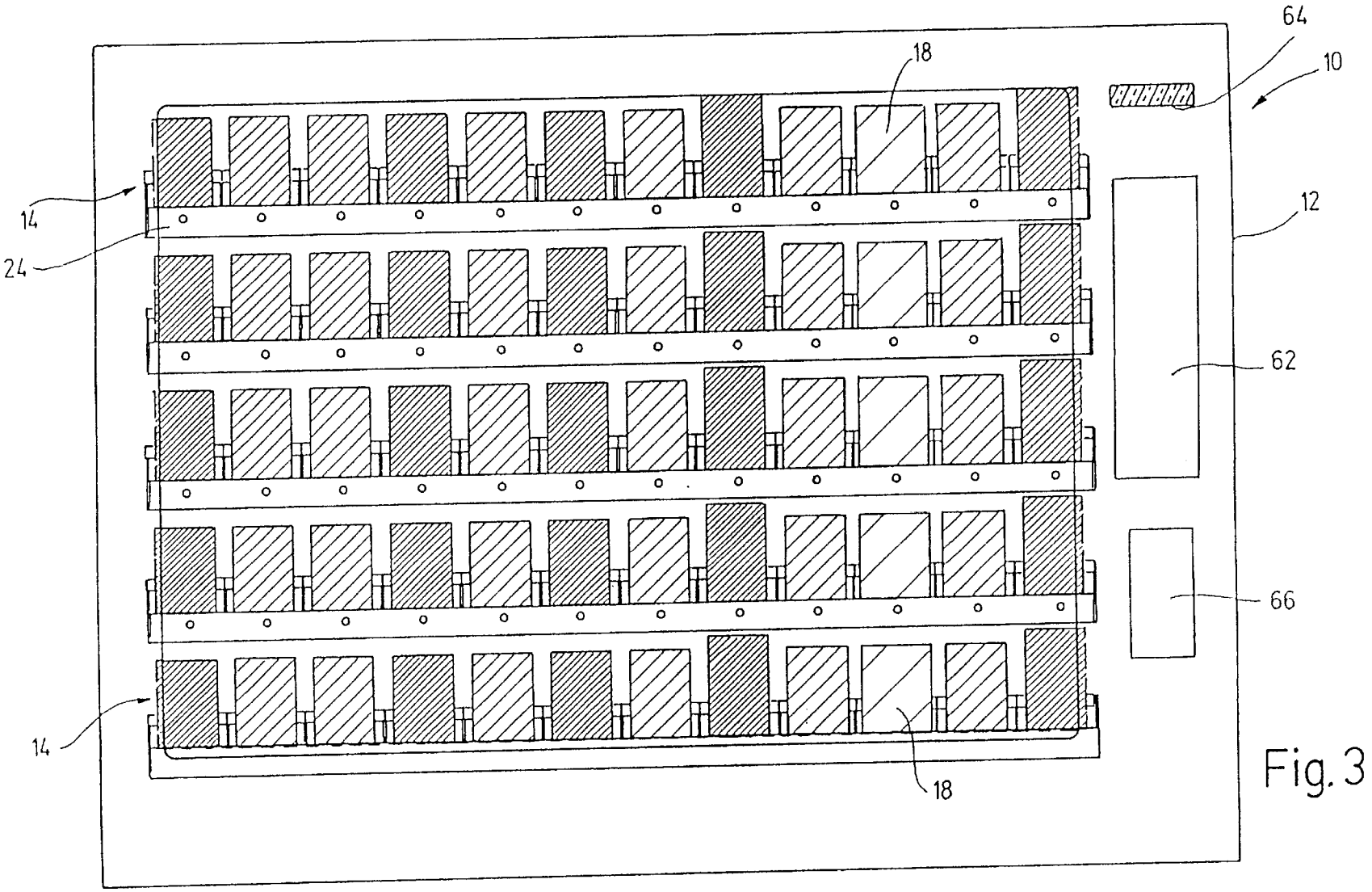
FIG. 3 a front view of the cigarette vending machine according to FIG. 1.
Figure 4:
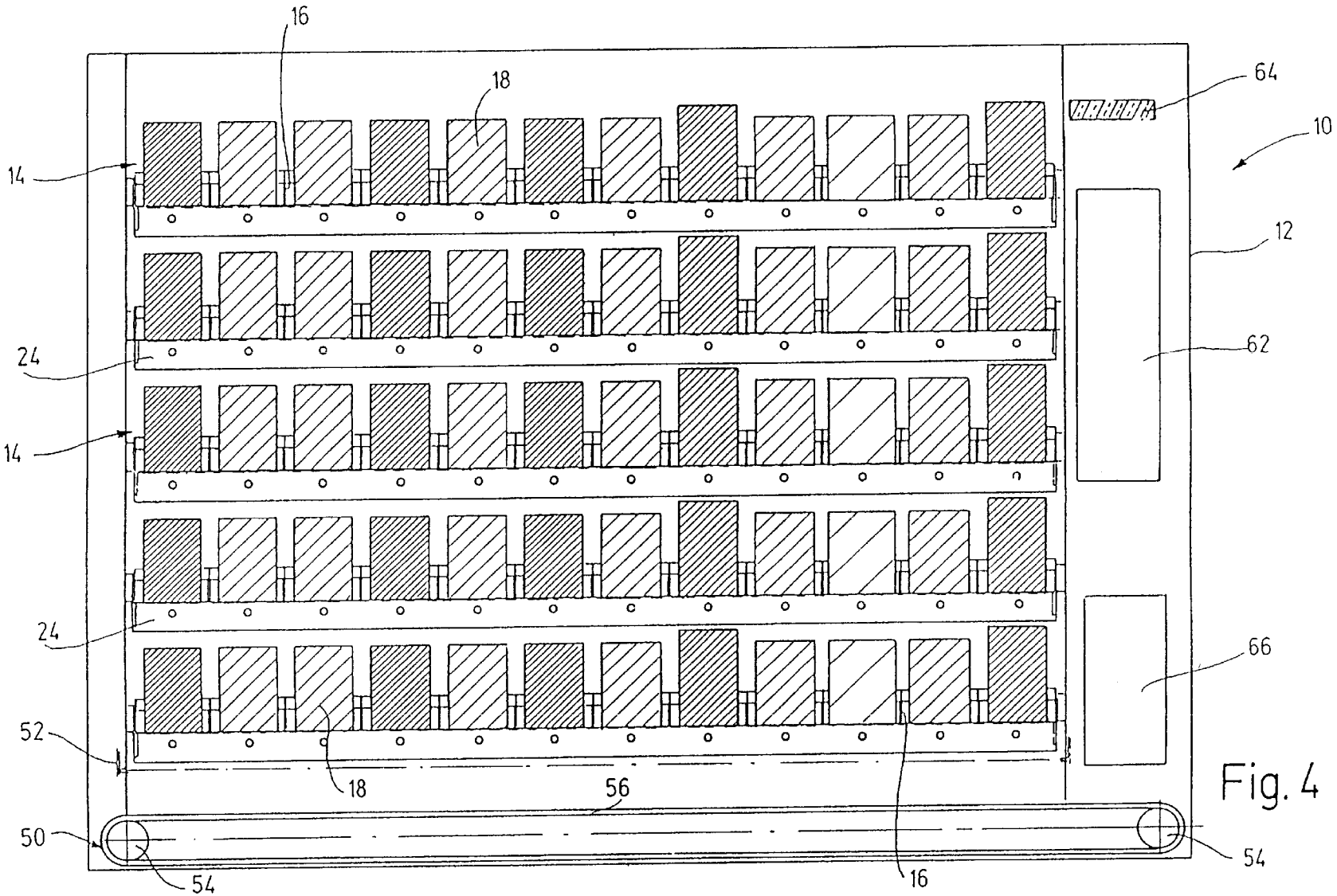
FIG. 4 a front view of the cigarette vending machine according to FIG. 1 with removed cover element.

The front side of the housing 12 includes a cover element 20 formed of glass or Plexiglas, which is mounted pivotably on the housing 12 and in FIG. 1 is shown in the closed position and in FIG. 2 is shown in the open position. When the cover element 20 is completely open the shafts 16 can be pulled forwards like drawers for refilling. In this position of the cover element 20 a safety switch (not shown in greater detail) ensures that an operation of the vending machine 10 is not possible. The opening of the cover element 20 is supported on one or both sides by a pressure cylinder or spring 22 connected to the sides of the housing 12.

The cigarette shaft levels 14 respectively exhibit on their front side a cover plate 24, which exhibits a slant forming a slide inclined towards the front side of the housing 12, so that ejected cigarette packs 18 can slide downwards over the slants. The forward edge of the cover plate projects beyond the foremost cigarette pack 18 situated in the thereunder lying shaft 16, so that an ejected cigarette pack can slide past a thereunder situated cigarette pack without bumping into it.

Figure 8A:
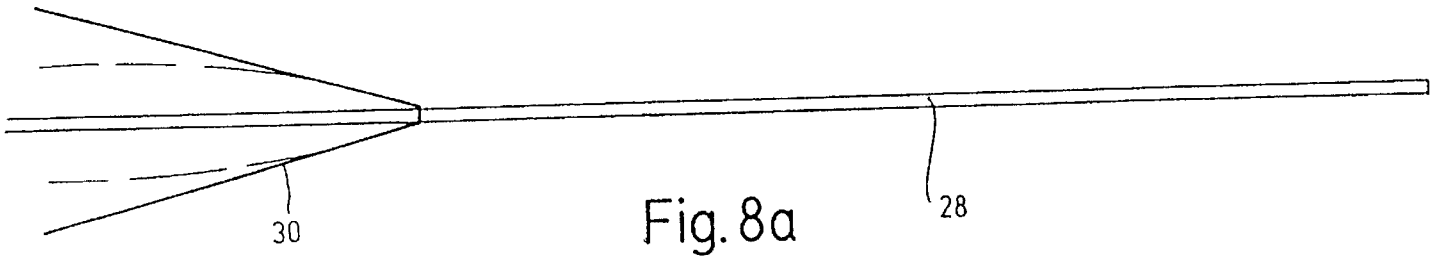
FIGS. 8*a* and *b* a top view and a side view of a shaft divider with a clamping spring.
Figure 8B:
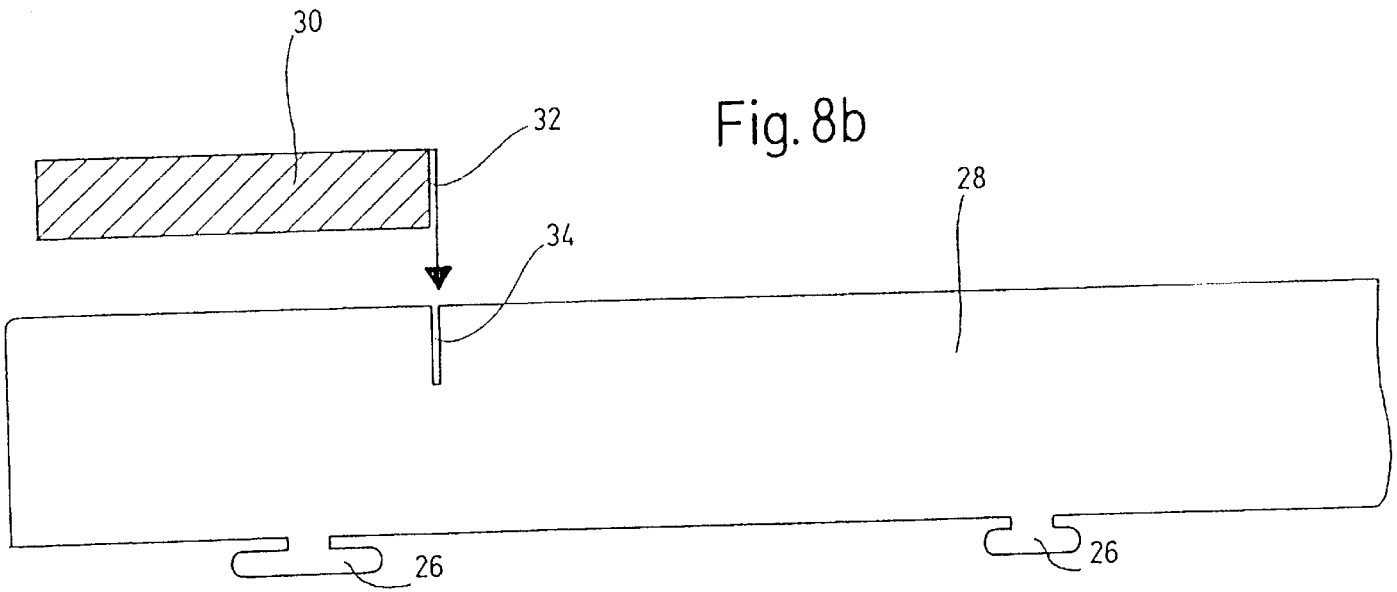

The shaft levels 14 include a floor of sheet metal with receptacle openings for insertion tongues 26 (FIG. 8*b*) of shaft dividers 28, which extend in the longitudinal direction of the shaft levels 14 and divide the individual shafts 16 from each other. The shaft dividers 28 are positioned equally spaced parallel to each other, so that the individual shafts 16 respectively have the same breadth and so that any of the cigarette packs with the most frequently occurring pack sizes can be introduced in any of the respective shafts. In order to prevent a sideways free play or misalignment of the cigarette packs 18, at least in the forward most area of the shaft 16, and to prevent an unintentional falling out of the packs, each shaft is provided with a clamping mechanism, which is formed of clamping springs acting sideways on the packs and formed as leaf springs 30. The leaf springs 30 are formed as V-shaped bent sheet metal parts of a spring-elastic material, preferably spring steel, which with their tips 32 are introduced in corresponding slits 34 in the shaft dividers 28 (FIGS. 8*a* and *b*). The free ends of the leaf spring 30 extend toward the front area of the shaft and border the sides of the exit openings.

Figure 6B:
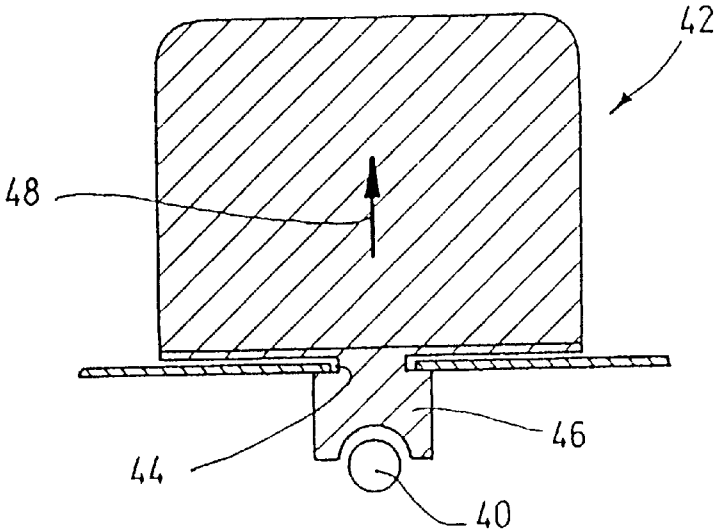
FIGS. 6*a* and *b* a detailed view of the push piece of the drive mechanism of the cigarette vending machine.
Figure 6A:
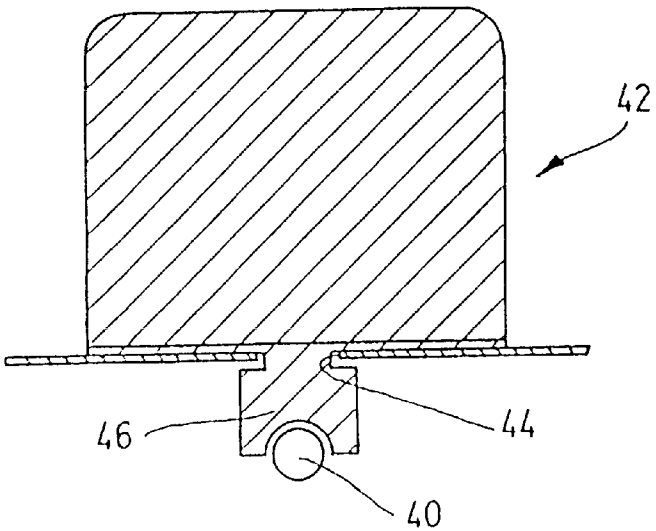
Figure 7:
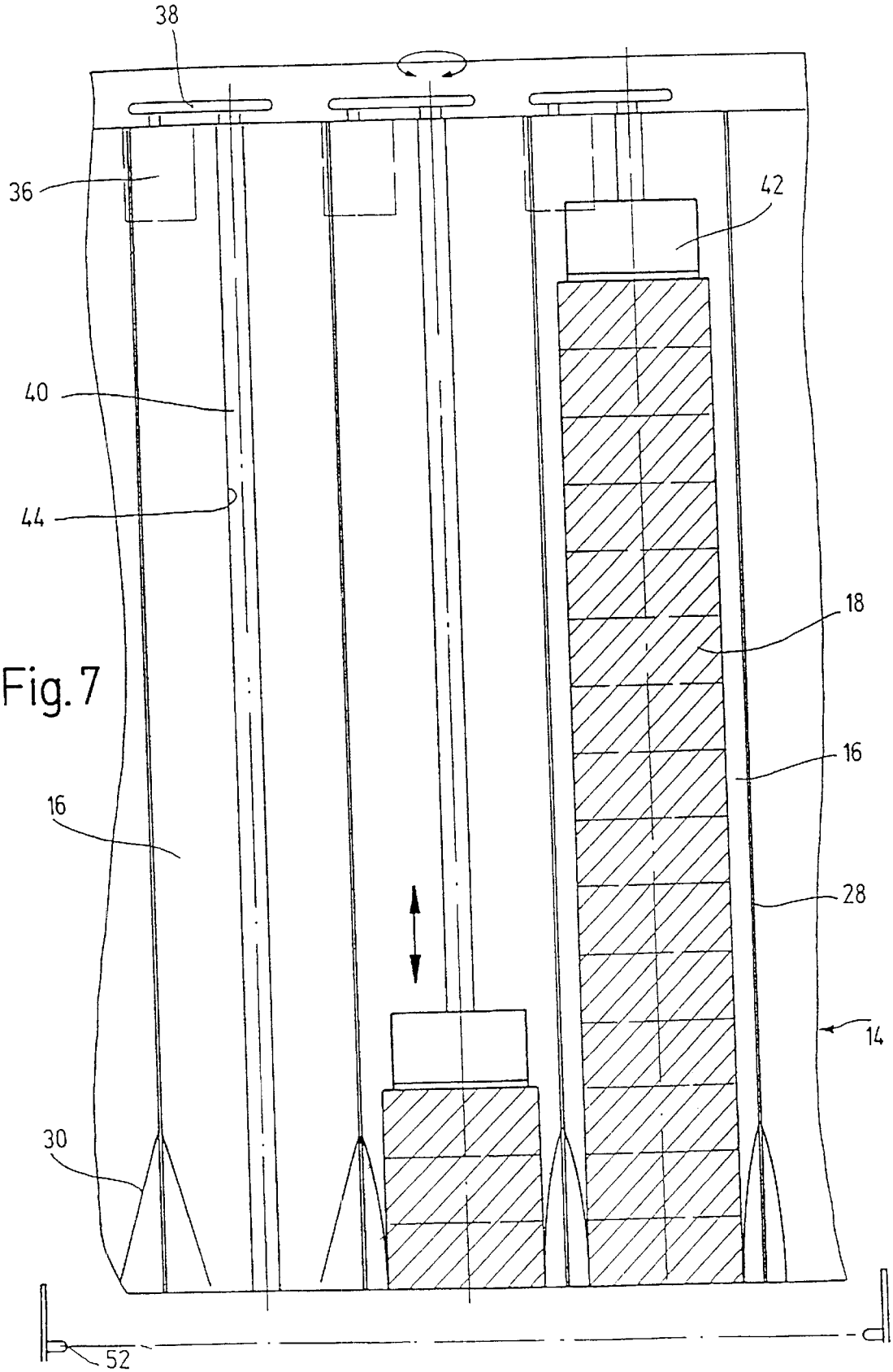
FIG. 7 a top view upon one section of a shaft level in operating condition.

The drive mechanism for any one of the shafts 16 includes an electric drive motor 36 provided in the rearward area of the shafts, which drives a spindle 40 extending in the longitudinal direction of the shaft and operates as a reduction gear drive 38, formed of a belt drive situated below the shaft. The spindle 40 having an external threading for its part drives a push piece 42 acting from behind on the pack shaft. This is comprised of a push part having an essentially L-shaped profile and positioned above the shaft floor, and a drive piece 46 guided in a guide opening 44 in the shaft floor, and positioned below the shaft floor, and including an internal threading for cooperating with the external threading of the spindle 40 (FIGS. 6*a* and *b*). On the basis of the gravitational force with which the pressure piece 42 rests upon the spindle it is not necessary that the drive piece 46 with its internal threading completely surround the spindle 40 in order to produce a secure transmission of the drive force. Rather, it is of particular advantage when the drive piece 46 surrounds the spindle with less than 180° as shown in FIGS. 6*a* and *b*, since then the drive piece can be lifted off of the spindle 40 in the direction of the arrow 48 when necessary, for example during restocking of the shaft with cigarette packs, so that it can be pushed back to the rearward starting position in a simple and rapid manner by hand. The drive piece 46 is further guided in the guide opening 44 with play, in order to make possible an unimpeded sliding of the push piece along the shaft.

The control of the drive mechanism occurs on the user side by the selection of a cigarette pack via a keyboard provided on the front side of the housing 12, which is described below in greater detail. The switching off of the drive mechanism after the ejection of a cigarette pack 18 occurs by a control signal, which is produced by a light sensor or light barrier 52 provided above the conveyor device 50 provided in the lower front area of the housing, and monitoring the entire breadth of the shaft level 14, for detecting when the downward falling cigarette pack 18 interrupt this light sensor or light barrier 52. The drive speed of the drive mechanism is therein so selected, that the downward falling cigarette pack 18 passes through the light switch 52 and therewith triggers the stop signal for the corresponding drive mechanism, before a second pack can be ejected from the same shaft.

The conveyor device 50 provided in the lower front area of the housing 12 includes two rollers or cylinders 54 situated left and right in the housing 12, of which at least one is driven. A conveyor band or, as shown in the illustrated embodiment, a series of individual strips 56 are tensioned over the rollers or cylinders 54, which provide a support surface for the cigarette packs falling down and to be transported.

Figure 5:
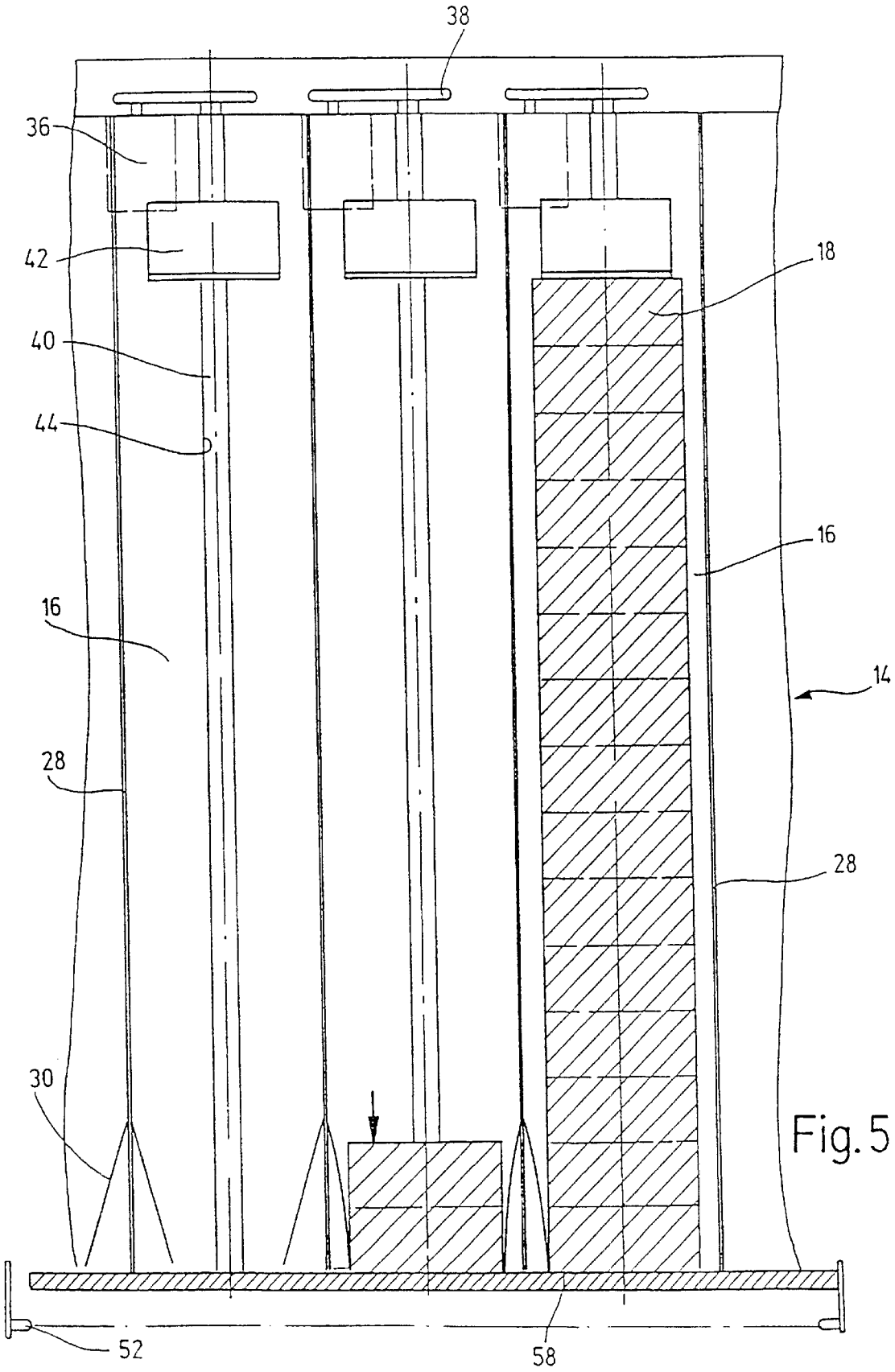
FIG. 5 a top view upon an area of a shaft level of the cigarette vending machine in the loading position.

For stocking the cigarette shafts 16 with the cigarette packs the shafts 14 can be pulled out from the housing 12 in the manner of drawers as shown in FIG. 2. A further simplification of the refilling of the vending machine is achieved by a refilling member 58, which can be introduced or seated onto capturing hooks 60 provided left and right on the shaft level 14, and which covers the front side exit opening of the shaft 16 (FIG. 5). When the refilling member 58 is not in use it can be stored in a suitable position in the housing 12.

On the front side of the housing 12 there is a keyboard 62 for controlling the drive mechanism of any respective defined shafts 16. On a display device 64 provided in the area of the keyboard 62 the selection made by the user is additionally graphically displayed. Further, in the lower front area of the housing 12, above the conveyor device, a not shown slide is provided, which directs the upright downward falling cigarette pack 18 onto the conveyor belt 22, and thereby tilts it from the upright position into a lying position for transport in the outer area of the housing 12. The area of the conveyor device exiting out of the housing 12 comprises an opening in the sidewall. Finally, a return slot 66 is provided on the front side of the housing 12 for return of erroneously selected cigarette packs, behind which a not shown collection container is provided, which in regular intervals can be removed from the housing for emptying out by the service personnel.

In summary the following is to be concluded: The invention relates to a cigarette vending machine, especially for installing in the checkout area of a market or the like, comprising a housing 12 wherein several cigarette shafts 16 are located 16. These shafts accommodate columns of cigarette packs 18 which are oriented upright with their broad sides resting on each other. A discharge outlet for individual cigarette packs is located at the front of the shafts 16. The aim of the invention is to provide a simple means of discharging a cigarette pack whilst ensuring that the packs are suitably presented to the customer. The pack should not however be removed directly from the supply shaft. To this end, an optionally controllable drive mechanism 36, 38, 40 is allocated to each shaft 16. Each drive mechanism has a pressure piece 42 which exerts pressure acting on the back of the rearmost cigarette pack 18 in the column of packs, urging frontwards. A clamping mechanism 30 for the cigarette packs is also located in the front area of each shaft 16, this clamping mechanism forming the discharge opening when it is open.

What is claimed is:

1. A cigarette vending machine, comprising:

a housing (12) having a front side and a rear side, multiple cigarette shafts (16) having a longitudinal axis, a front side and a back side, wherein the multiple cigarette shafts are provided within the housing (12) for receiving a shaft comprised of cigarette packs (18), each cigarette packs having a broad side and a narrow side, wherein the cigarette packs are arranged standing up in rows, wherein each row includes a first cigarette pack and a last cigarette pack, wherein the broad side of each cigarette pack is positioned against the broad side of the adjacent cigarette pack on the row, and an exit opening located at the front side of each shaft (16), a selectively controllable drive mechanism (36, 38, 40) associated with each shaft (16), wherein the controllable drive mechanism includes a push piece (42) acting on the last cigarette pack urging the row of cigarette packs towards the front side of the shaft, and a clamping mechanism (30) provided in the front side of each shaft (16) wherein the clamping mechanism acts as a restraint to the first cigarette pack;

wherein shafts (16) situated on a common plane form a shaft level (14), which is provided slidably in the housing (12) in the manner of drawers to facilitate restocking with cigarette packs (18); and wherein each shaft level (14) includes on its sides two capture hooks (60) projecting beyond the front of the shaft level (14), adapted for receiving a refilling member (58) which covers the shaft front during restocking of the shaft (16).

2. A cigarette vending machine according to claim 1, wherein each shaft level (14) is provided with a cover plate (24), the cover plate having a front edge, a back edge, top edge, a lower edge and extending over the breadth of the shaft, with an outwardly and downwardly directed slide-forming slanted surface.

3. A cigarette vending machine according to claim 2, wherein the slanted surface of the cover plate (24) projects beyond the first cigarette pack (18) situated in the shaft level (14).

4. A cigarette vending machine according to claim 2, wherein the lower edge of the cover plate (24) in the area of the slanted surface is spaced apart from the upper edge of the cover plate of the shaft (16), by a spacing which exceeds the height of a cigarette pack (18).

5. A cigarette vending machine according to claim 2, wherein the front edge of the cover plate (24) has a spacing from a cover element (20) which exceeds the thickness of the cigarette packs (18).

6. A cigarette vending machine according to claim 1, wherein the drive mechanism (36, 38, 40) includes a spindle (40) extending in the longitudinal axis of the shaft and operatively associated with the push piece (42).

7. A cigarette vending machine according to claim 1, further comprising a conveyor device (50) provided in the lower front area of the housing (12) for transporting away cigarette packs, wherein the conveyor device further comprises an exit side.

8. A cigarette vending machine according to claim 7, wherein a light sensor or barrier (52) monitoring the breadth of the shaft levels (14) is provided above the transport device (50) for producing a turn-off signal for the drive mechanism (36, 38, 40) of a shaft (16) after the ejection of a cigarette pack (18).

9. A cigarette vending machine according to claim 7, wherein the conveyor device (50) is formed as a conveyor belt or multiple conveyor strips (56) arranged parallel to each other.

10. A cigarette vending machine according to claim 7, wherein in the area of the conveyor device (50) a slide is provided for the cigarette packs (18), which tilts the cigarette packs sliding thereon from a standing position into a lying position for further transport.

11. A cigarette vending machine according to claim 7, wherein in the exit side area of the conveyor device (50) a light sensor or light barrier is provided for detecting a transported-out cigarette pack (18).

12. A cigarette vending machine according to claim 1, wherein each drive mechanism includes an electric drive motor (36) and a transmission means (38).

13. A cigarette vending machine according to claim 12, wherein the transmission means (38) can be selected from the group consisting of a belt, a band, a chain and a gear drive.

14. A cigarette vending machine according to claim 12, wherein the transmission means (38) is a reduction gear drive.

15. A cigarette vending machine according to claim 1, wherein the clamping mechanism comprises at least two clamping springs (30) acting symmetrically on the first cigarette pack (18).

16. A cigarette vending machine according to claim 1, wherein the clamping mechanism includes at least one leaf spring extending in the longitudinal axis of the shaft.

17. A cigarette vending machine according to claim 16, further including a shaft divider (28) which divides the shafts (16) from each other in the longitudinal direction, and wherein each leaf spring (30) is formed as an essentially V-shaped piece of bent sheet metal, with its apex introduced into a slit (34) in the shaft divider (28).

18. A cigarette vending machine according to claim 1, wherein the housing (12) on its front side includes a cover element (20).

19. A cigarette vending machine according to claim 18, wherein said cover element includes a sheet of glass or PLEXIGLAS™.

20. A cigarette vending machine according to claim 18, wherein the cover element (20) is mounted pivotably or foldably on the housing (12) between an open position and a closed position for exposing the shaft levels (14) when in the open position.

21. A cigarette vending machine according to claim 18, including a safety switch operated by the cover element (20), which interrupts operation when the cover element is open.

22. A cigarette vending machine according to claim 1, wherein the shafts (16) are provided essentially horizontally in the housing (12).

23. A cigarette vending machine according to claim 1, wherein the shaft levels (14) have a floor comprised preferably of sheet metal.

24. A cigarette vending machine according to claim 23, wherein the floor of the shaft levels (14) further comprises guide openings (44) extending in the longitudinal axis of each shaft (16).

25. A cigarette vending machine according to claim 1, wherein the push piece (42) includes a drive piece (46) provided with an internal threading which cooperates with an external threading of an spindle (40) which is driven by the drive mechanism, the spindle is guided in a guide opening (44) of the shaft floor.

26. A cigarette vending machine according to claim 25, wherein the push piece further including a drive piece (46) loosely guided in the guide opening (44).

27. A cigarette vending machine according to claim 25, wherein the internal threading of the guide piece (46) encompasses the spindle (40) with not more than 180°, so that the push piece (42) can be lifted off of the spindle (40).

28. A cigarette vending machine according to claim 24, wherein the guide opening (44) includes an open edge on at least one end.

29. A cigarette vending machine according to claim 1, including a keyboard (62) provided on the front side of the housing (12) or the cover element (20) for controlling the drive mechanism (36, 38, 40) of a selected shaft (16).

30. A cigarette vending machine according to claim 29, wherein the individual keys of the keyboard (62) are arranged in the form of a matrix corresponding to the individual shafts (16) and that the position of each key in the keyboard (62) corresponds to the position of a shaft (16).

31. A cigarette vending machine according to claim 29, wherein the keyboard (62) is a numeric keyboard, wherein each shaft (16) is assigned a position number and the desired cigarette pack (18) can be ejected by the input of the position number of the corresponding shaft (16).

32. A cigarette vending machine according to claim 29, wherein in the area of the keyboard (62) or on the front side of the housing (12) a display device (64) is provided for indicating the respective selected shaft (16) or the shaft number, and that the keyboard (62) includes a confirmation key which actuates the drive mechanism (36, 38, 40) of the corresponding shaft (16) and the ejection of the selected cigarette pack (18).

33. A cigarette vending machine according to claim 18, including a remote control switch located remote from the vending machine, for disabling or enabling the vending machine.

34. A cigarette vending machine according to claim 1, further including a device emitting an acoustic signal actuated by the operation of the vending machine.

35. A cigarette vending machine according to claim 1, further including a counting device which registers the number of sales.

* * * * *